US007188715B1

(12) United States Patent
Chen

(10) Patent No.: US 7,188,715 B1
(45) Date of Patent: Mar. 13, 2007

(54) PULL HANDLE PROVIDED WITH A GRIP HANDLE WITH AN ADJUSTABLE ANGLE

(76) Inventor: Shou Mao Chen, No. 344, Sec. 1, Chung Shan Rd., Ta Cha Township, Taichung Hsien (TW)

( * ) Notice: Subject to any disclaimer, the term of this patent is extended or adjusted under 35 U.S.C. 154(b) by 601 days.

(21) Appl. No.: 10/765,604

(22) Filed: Jan. 28, 2004

(51) Int. Cl.
*A45C 5/14* (2006.01)

(52) U.S. Cl. ..... 190/115; 16/113.1; 280/37

(58) Field of Classification Search ..... 190/18 A, 190/115; 16/113.1; 280/37
See application file for complete search history.

(56) References Cited

U.S. PATENT DOCUMENTS 5,689,854 A * 11/1997 Wang ..... 16/113.1
5,713,441 A * 2/1998 Chen ..... 190/115
5,901,822 A * 5/1999 Tu ..... 190/115
6,409,207 B1 * 6/2002 Kuo ..... 280/655.1
6,508,344 B1 * 1/2003 Lu ..... 190/115
6,874,604 B2 * 4/2005 Miller et al. ..... 190/39
6,892,866 B2 * 5/2005 Wu ..... 190/115
7,070,190 B2 * 7/2006 Sadow ..... 280/37
7,097,181 B2 * 8/2006 Sadow ..... 280/37

* cited by examiner

*Primary Examiner*—Tri M. Mai
(74) *Attorney, Agent, or Firm*—Egbert Law Offices

(57) ABSTRACT

An adjustable grip angle of the grip handle specific to a pull handle of luggage compartment. The bottom of the grip handle is provided with a connecting base, which makes the grip handle rotate round the pivot. A linkage bar is vertically provided within the grip handle. The top of the linkage bar is activated by the button while the bottom of the linkage bar is extended to the base of the grip handle. A rotary bar is provided at the bottom of the linkage bar. The back end of the rotary bar is provided with a fixation pin, which can shift vertically. The top of the fixation pin is connected to the second bar end of the rotary bar. The top of the connecting base is provided with at least two fixation holes, both of which can be joined with the base of fixation pin so as to fix the angle of grip handle when the grip handle stands upright, or stands by a preset degree of curvature.

7 Claims, 12 Drawing Sheets

PULL HANDLE PROVIDED WITH A GRIP HANDLE WITH AN ADJUSTABLE ANGLE

FIELD OF THE INVENTION

The present invention relates generally to a pull handle of a luggage compartment, and more particularly to a pull handle whose grip handle can be adjusted for comfortable grip angles.

BACKGROUND OF THE INVENTION

Owing to the extensible function of the pull handle of a conventional luggage compartment, the end-users can pull up the grip hand and extend the pull handle when dragging the luggage compartment. This design, in fact, has offered a comfortable grip to some extent. However, when the end-users drag the luggage compartments, they can find that the inclination grade of the luggage compartment will also affect the dragging effect. Furthermore, when the conventional luggage compartment of such design is dragged with its pull handle extended to a fixing state, the top end of the luggage compartment will be tilted approximate to 45°. In such a case, as the luggage compartment presses the pull handles, the end-users will feel a sense of heaviness, which is directly proportional to the top end of the luggage compartments. Though the end-users can adjust the inclination grade to reduce the sense of heaviness by raising their arms, this action will surely lead to a sensation of aching.

Therefore, this industry shall assume the responsibility of making some pioneering R&D so as to improve the structural design of the pull handle and grip handle of luggage compartment.

BRIEF SUMMARY OF THE INVENTION

The present invention can offer an improved efficiency as detailed below.

To provide an innovative pull handle of luggage compartment that the grip handle can be adjusted for comfortable grip angles, which is an ideal utility model in the industry.

Based upon this modified structural design, the present invention is aimed at adjusting the angle of the grip handle specific to a pull handle of a luggage compartment for a service mode of another degree of curvature. So, when the grip handle is in the same holding position, it is possible to reduce the inclination grade of the luggage compartment for more comfortable application.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

As shown in FIGS. 1–5, a pull handle of a luggage compartment is embodied in the present invention.

Figure 8:
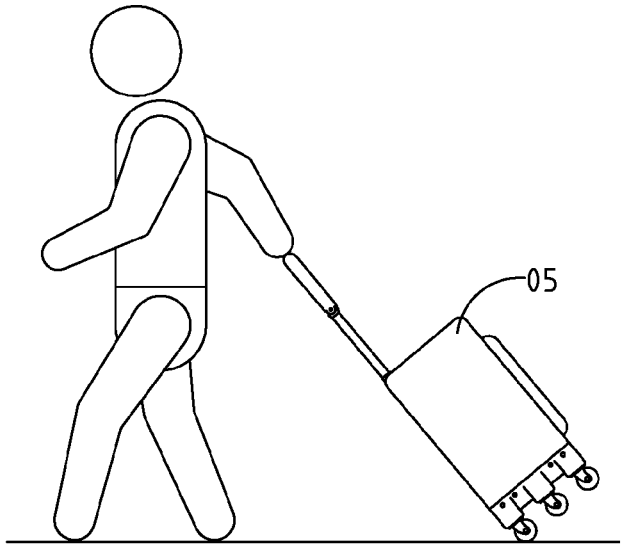
FIGS. 8–9 show perspective views of examples of the grip handle of the present invention in operation.

The invention includes a pull handle 10, provided with a grip handle 20 and a button 30. The pull handle 10 is provided at one side of the luggage compartment 05 (as shown in FIG. 8), the grip handle 20 at the top of the pull handle 10 and the button 30 at the top of the grip handle 20.

The invention also has a bottom of the grip handle 20, provided with a connecting base 40, which makes the grip handle 20 rotate round the pivot 21. And, the bottom of the connecting base 40 is mounted with an insert unit 41 to insert the top of the pull handle 10.

There is a linkage bar 50, which is vertically provided within the grip handle 20. The top of the linkage bar 50 is activated by the button 30 while the bottom of the linkage bar 50 is extended to the base of the grip handle 20.

The invention further includes a revolving pivot 63, which the rotary bar 60 is provided at the bottom of the linkage bar 50. The bar ends can swing as seesaw while the first bar end 61 of the rotary bar 60 is connected to the bottom of the linkage bar 50 for its activation.

There is a fixation pin 70, provided at the back end of the rotary bar 60. The fixation pin 70 can shift vertically along a preset track 22 inside the grip handle 20. The top of the fixation pin 70 is connected to the second bar end 62 of the rotary bar 60, which can activate it to shift vertically. When shifting downwards, the bottom of the fixation pin 70 can protrude from the base of the grip handle 20. And, the top of the fixation pin 70 is mounted with an elastic member 23 to let the fixation pin 70 elastically push downwards.

The invention includes two fixation holes 81 82, which are separately arranged at the top of the connecting base, of which the first fixation hole 81 can be joined with the base of fixation pin 70 when the grip handle 20 stands upright, and the second fixation hole 82 can be joined with the base of fixation pin 70 when the grip handle 20 stands by a preset degree of curvature. Thus, it is possible to insert the base of fixation pin 70 into the corresponding fixation hole 81 or 82 so as to fix the angle of grip handle 20.

Figure 1:
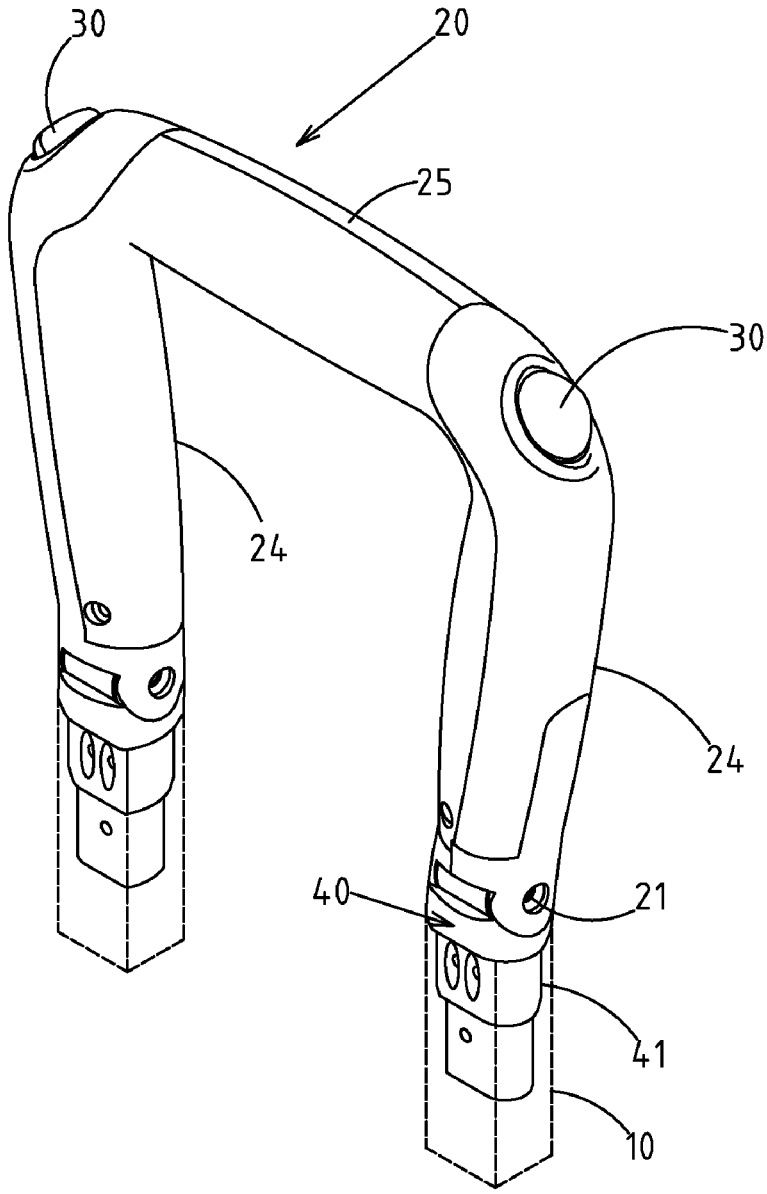
FIG. 1 shows a perspective view of the grip handle of the present invention.
Figure 2:
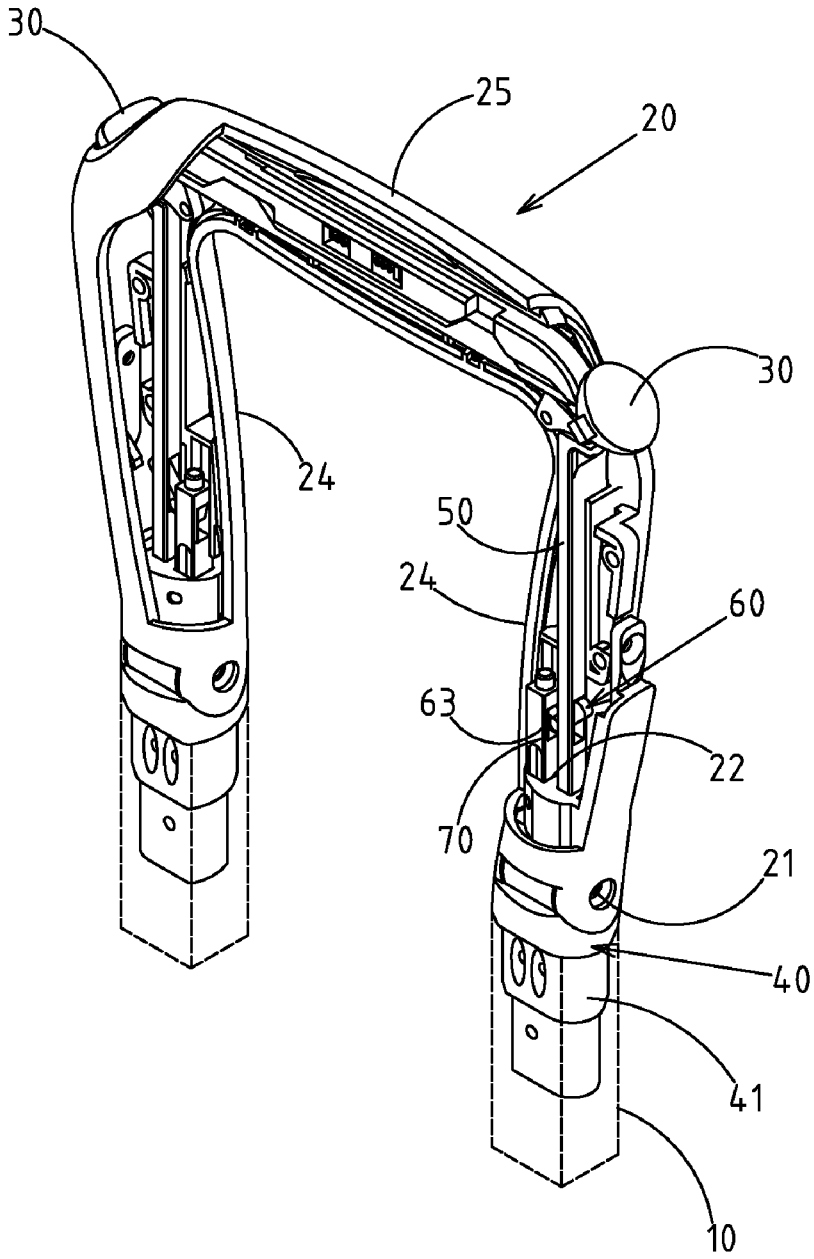
FIG. 2 shows a cross-sectional view of the internal structure of the grip handle of the present invention.
Figure 3:
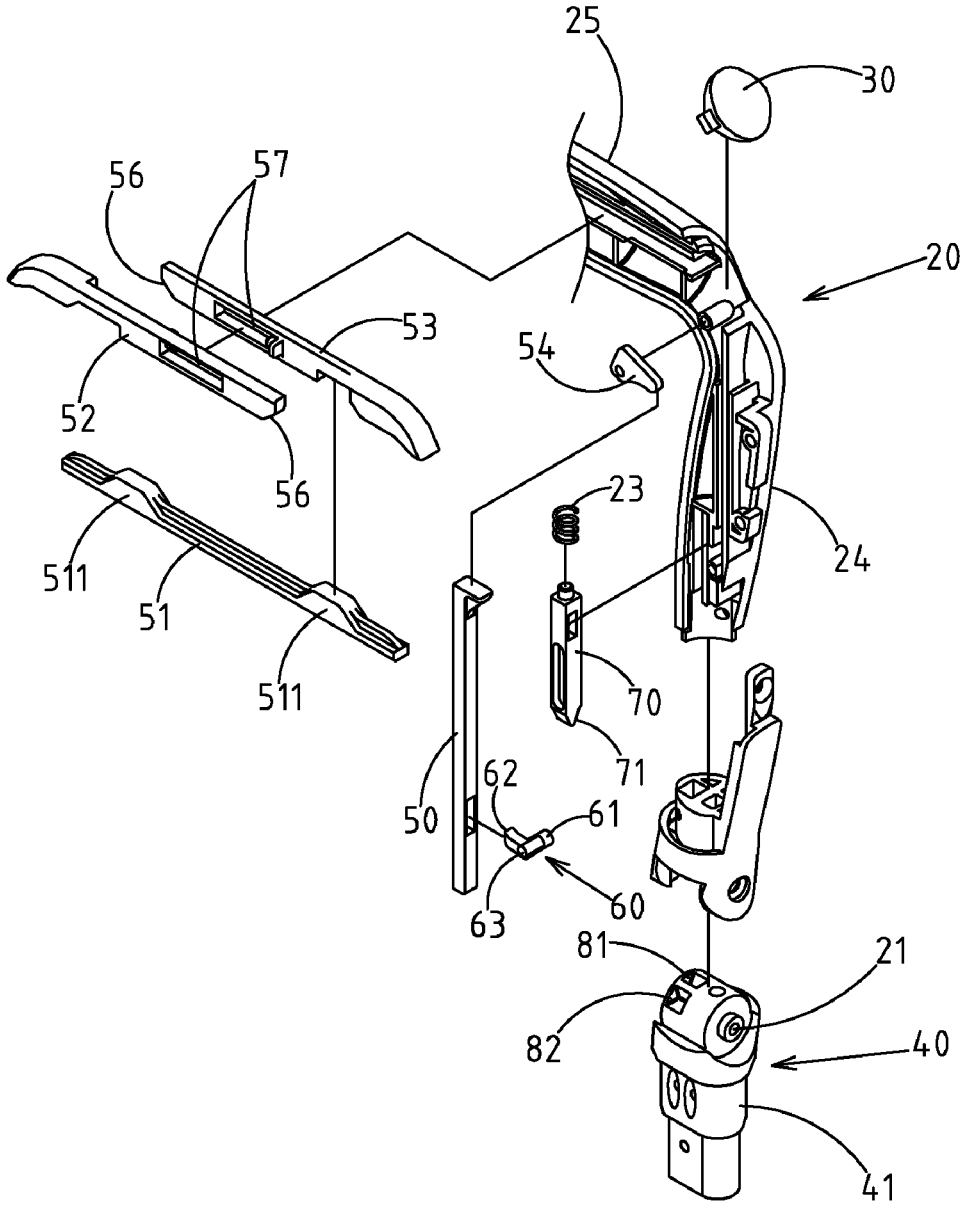
FIG. 3 shows an exploded perspective view of the local structure of the grip handle of the present invention.
Figure 4:
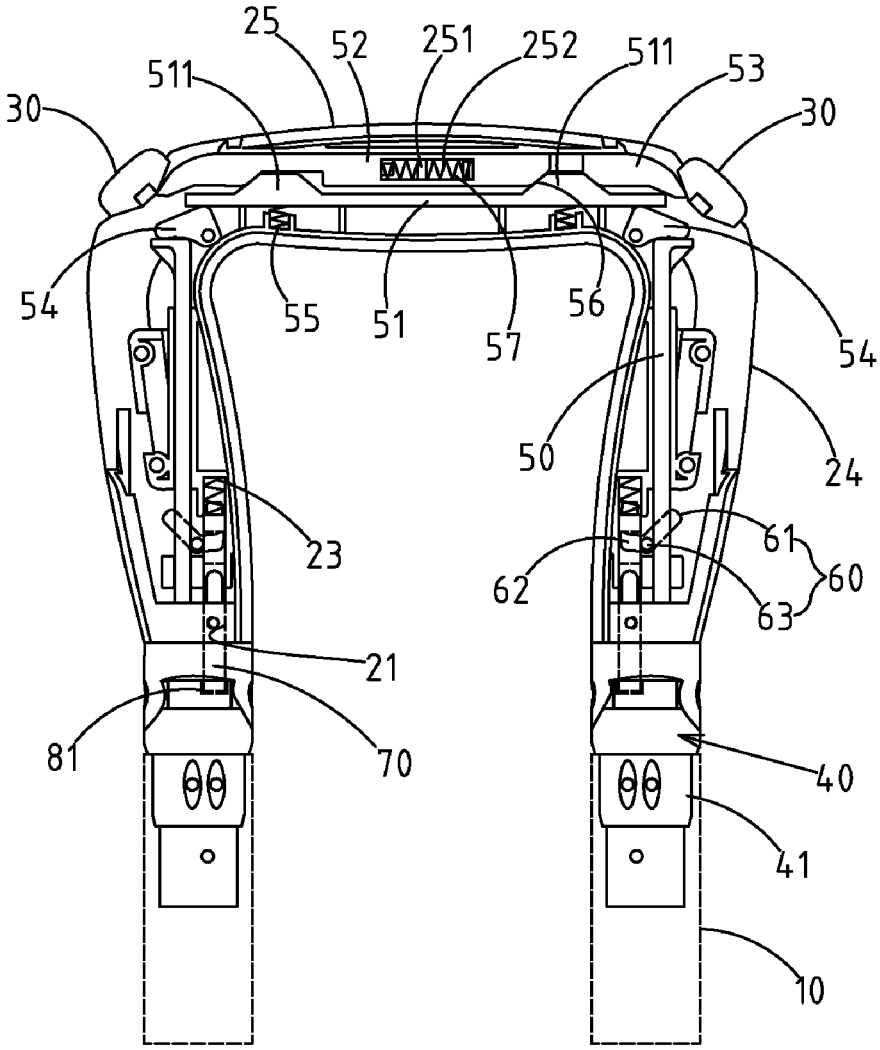
FIG. 4 shows a cross-sectional view of the internal structure of the grip handle of the pull handle at an upright state.

As shown in FIGS. 1–3 for the first example of the grip handle in present invention, the grip handle 20 is of a type, which has connecting bars 24 at the left and right sides and a horizontal handle 25 between the connecting bars. And, two groups of button 30, connecting base 40, linkage bar 50, rotary bar 60 and fixation pin 70 as well as two fixation holes 81 82 are provided symmetrically within the connecting bars 24 at the left and right sides of the grip handle 20. Besides, a horizontal transmission member (as illustrated in the following paragraph) is provided between the tops of left and right linkage bars 50 so as to connect left and right linkage bars 50. Thereupon, it is possible to activate simultaneously left and right linkage bars 50 when pressing any button 30.

In the embodiment of the present invention described above, the horizontal transmission member comprises a balance pressure bar 51, internal/external gliding base 52 53 and left/right transmission block 54. The left and right transmission blocks is of right-angled triangle type, which are connected at both sides of horizontal handle 25 of the grip handle 20 via the help of shaft axle, and placed at the tops of left and right linkage bars 50. The balance pressure bar 51 is horizontally provided within horizontal handle 25 of the grip handle 20, with its bottom of both sides separately spanning over left and right transmission blocks 54. And, a spring 55 is arranged between its bottom side and the lower wall of the horizontal handle 25 so as to uplift elastically the balance pressure bar 51. The topside of the balance pressure bar 51 is separately arranged with left and right stair-shape convexes 511. The internal and external gliding bases 52 53 are provided at the upper side of the balance pressure bar 51 for parallel connection. The outer side of internal and external gliding bases is separately connected to left and right buttons 30 while the inner side is provided with inclines 56 and separately connected to left and right stair-shape convexes 511 of the balance pressure bar 51. The intermediate section of internal and external gliding bases 52 53 is provided with a hollow notch 57. A rebound spring 252 is placed between a notch wall of one side and a fixed wall 251 of the horizontal handle 25, so as to enable internal and external gliding bases 52 53 to push elastically towards the button 30.

Figure 5:
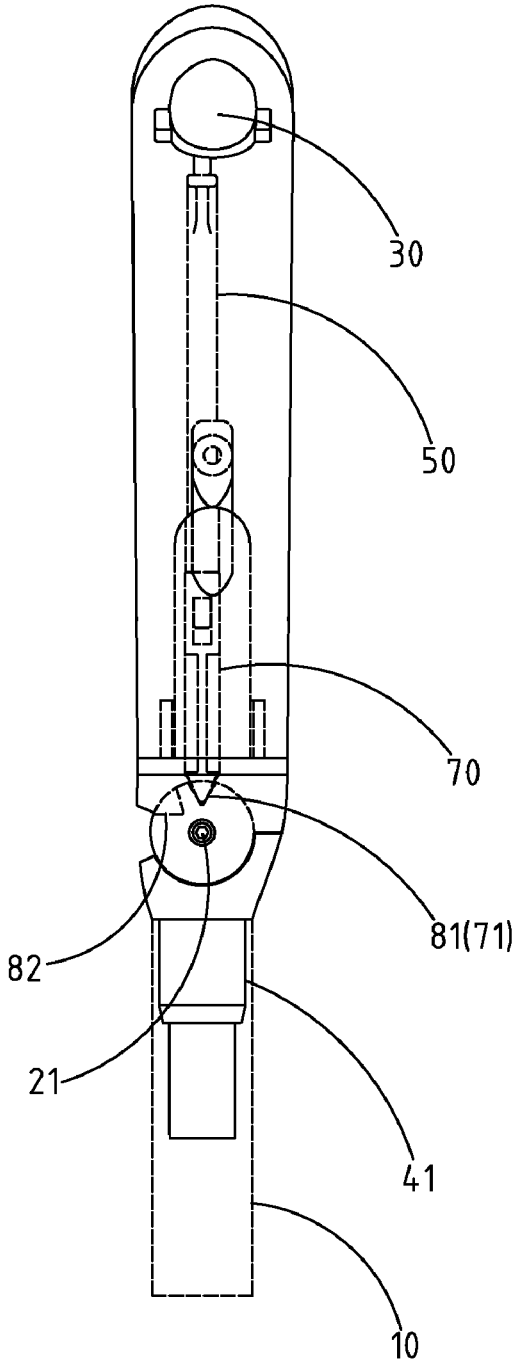
FIG. 5 shows an elevational view of another side at the upright state the same as in FIG. 4.
Figure 6:
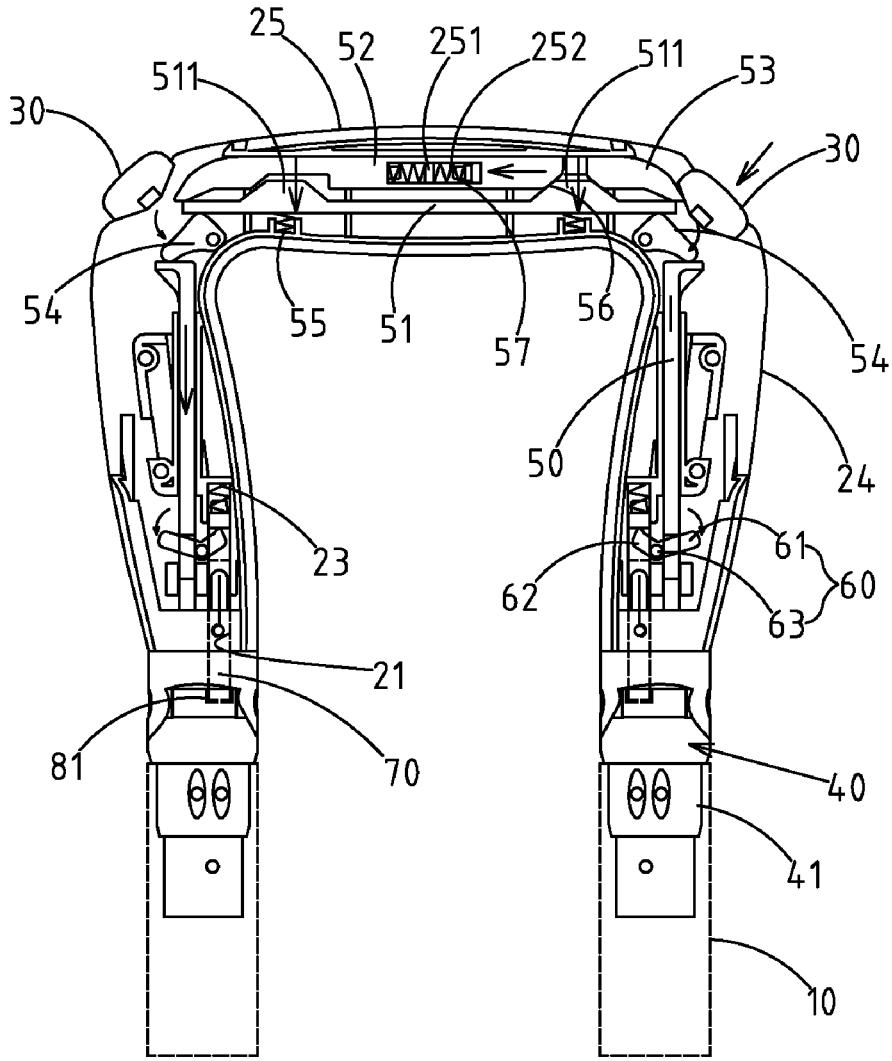
FIG. 6 shows a sectional view of the button of the present invention.
Figure 7:
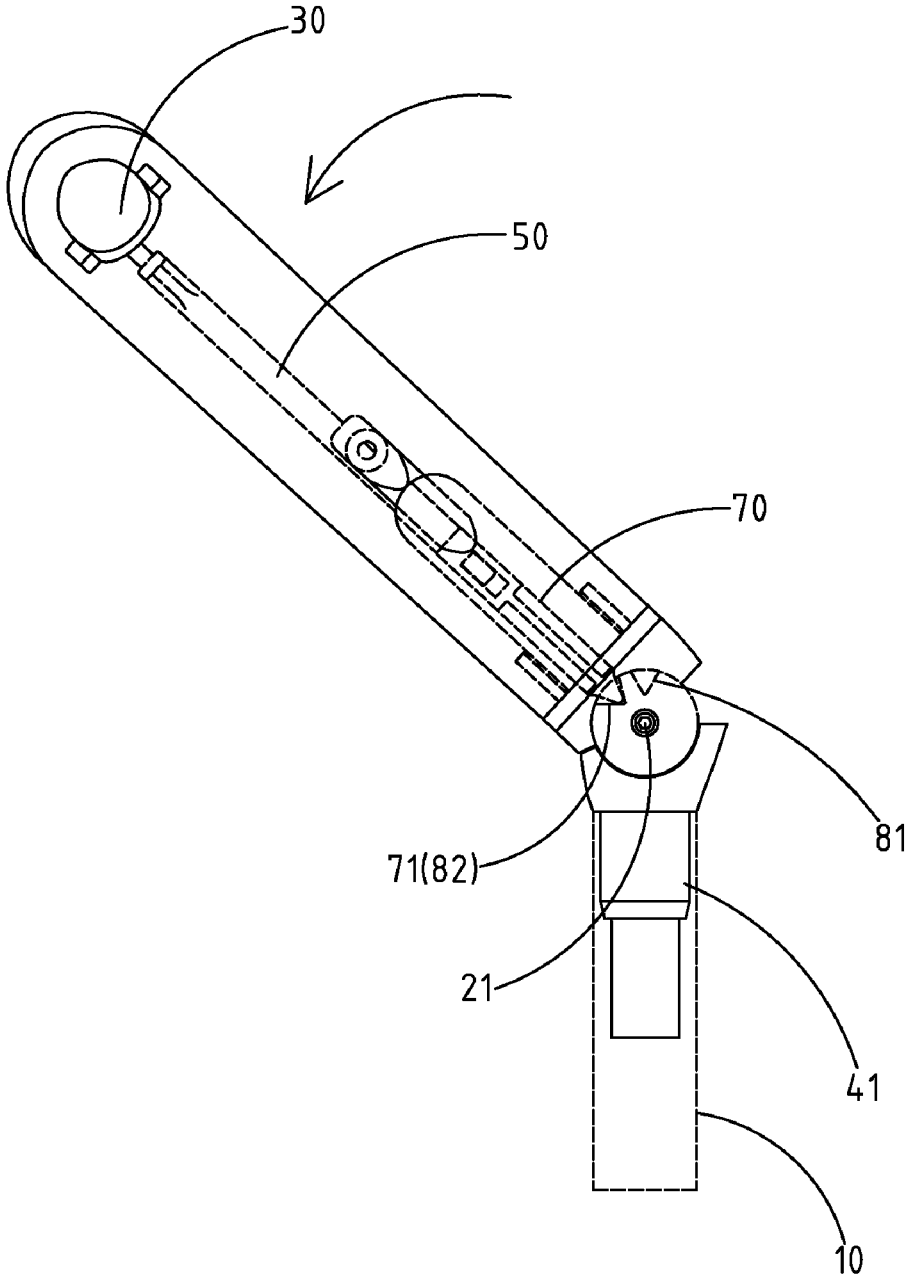
FIG. 7 shows a side elevational view of the fixed grip handle at a degree of curvature.

Based upon the above-mentioned structure and composition, when pressing any button 30 as shown in FIGS. 5–6, it is possible to drive the internal gliding base 52 to shift towards another side, then enable the balance pressure bar 51 to shift downwards via the transmission between this incline 56 and stair-shape convex 511 incline. As the right angle topside of left and right transmission blocks 54 at the bottom of both sides are pressed during displacement, the sharp corner of the bottom will back off, then the left and right linkage bars 50 will be simultaneously activated to shift downwards, and then the rotary bar 60 will be activated to swing oppositely and make fixation pin 70 shift upwards and deviate from the first fixation hole 81. In such case, the grip handle 20 is in a service mode, so the end-user can turn the grip handle 20 into a preset angle (as shown in FIG. 7), and then release the button 30 to insert the fixation pin 70 into the second fixation hole 82, thus fixing the curvature of the grip handle 20.

Figure 9:
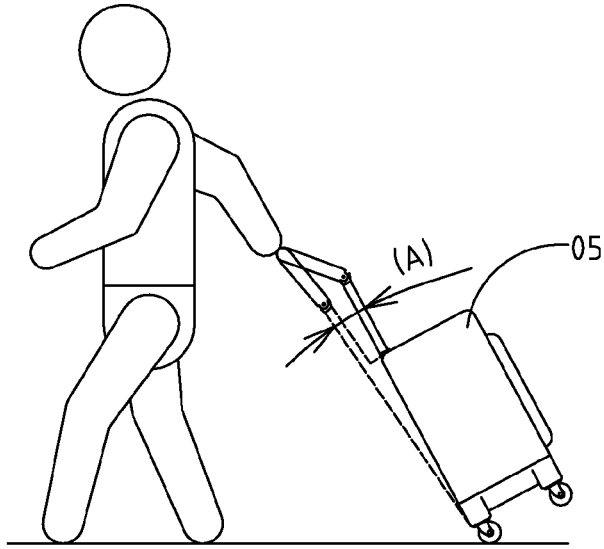

As shown in FIGS. 8–9 for the different designs, the present invention is aimed at adjusting the angle of the grip handle 20 specific to the pull handle of luggage compartment 05 for a service mode of another degree of curvature. So, when the grip handle is in the same holding position, it is possible to reduce the inclination grade of the luggage compartment 05 (refer to the different angles as shown in FIG. 9), and serve the purpose of a comfortable dragging.

Figure 13:
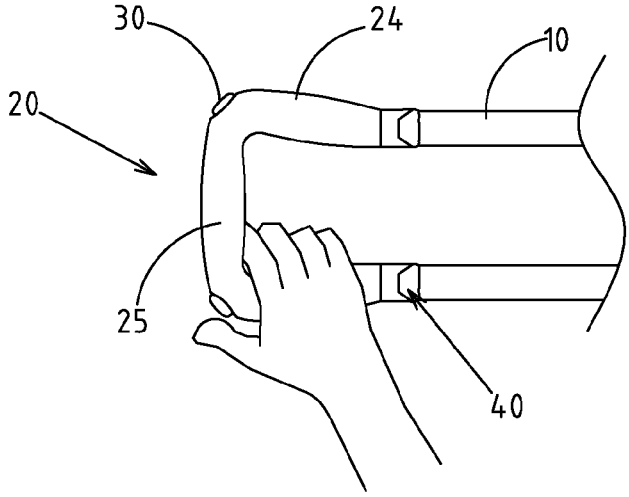
FIGS. 13–14 show perspective views of examples of the control and press mode of the button of the present invention.
Figure 14:
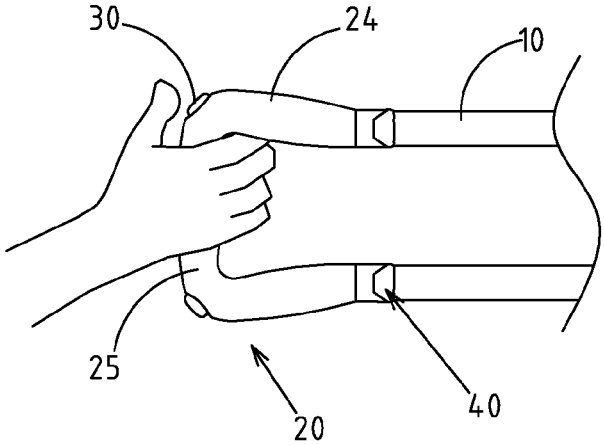

Additionally, when holding two-button grip handle 20 with above-specified type, the end-user can hold the left and right connecting bars 24 as shown in FIG. 13, or hold the horizontal handle 25 as shown in FIG. 14. Therefore, it applies to any kind of users owing to its strong operability.

Figure 11:
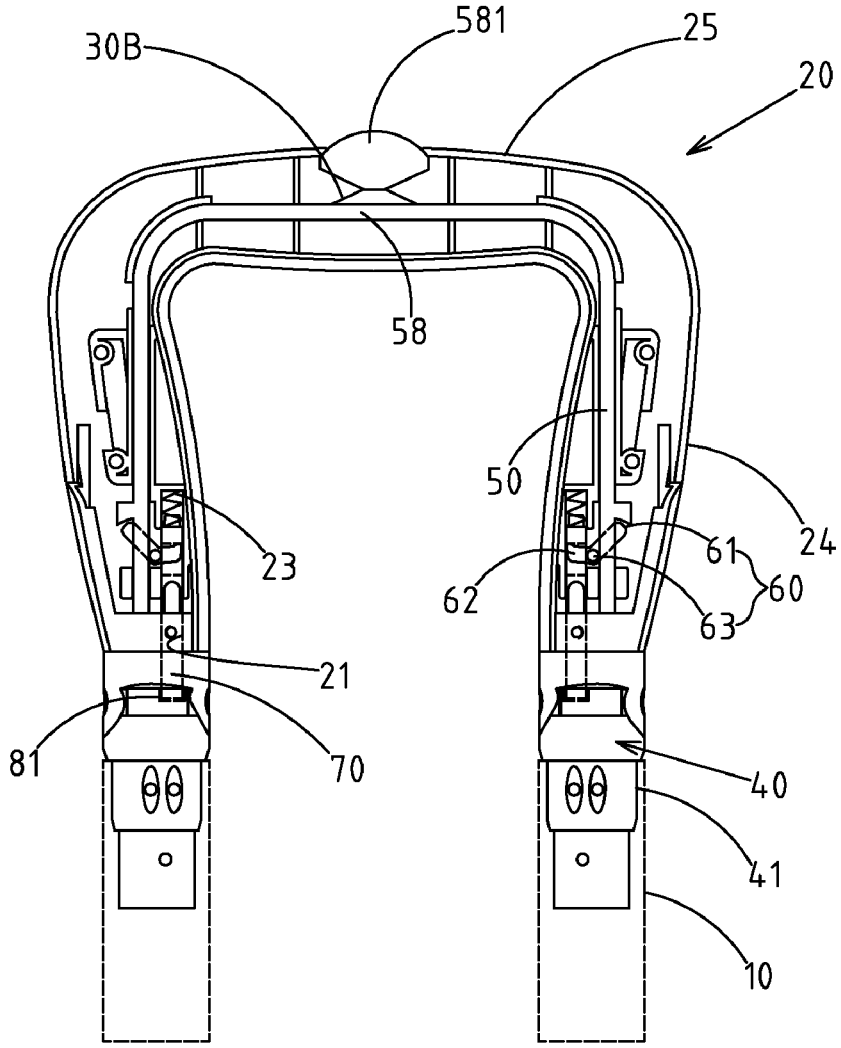
FIG. 11 shows a sectional view of an example of the internal transmission of the present invention.

As shown in FIG. 11, the horizontal transmission member is horizontally placed within the horizontal handle 25 of the grip handle 20, and its both ends are connected to the transverse handle 58 at the top of left and right linkage bars 50. Hence, a single-element button 30B is a preferred option, for the button 30B can be provided at the topside of the center of the horizontal handle 25, while a convexity 581 can be arranged at the topside of the center of the transverse handle 58 to abut upon the bottom of the button 30B. Thereupon, when pressing the button 30B, it will suppress the convexity 581 to push down the transverse handle 58, and then activate left and right linkage bars 50 to shift downwards.

Figure 12:
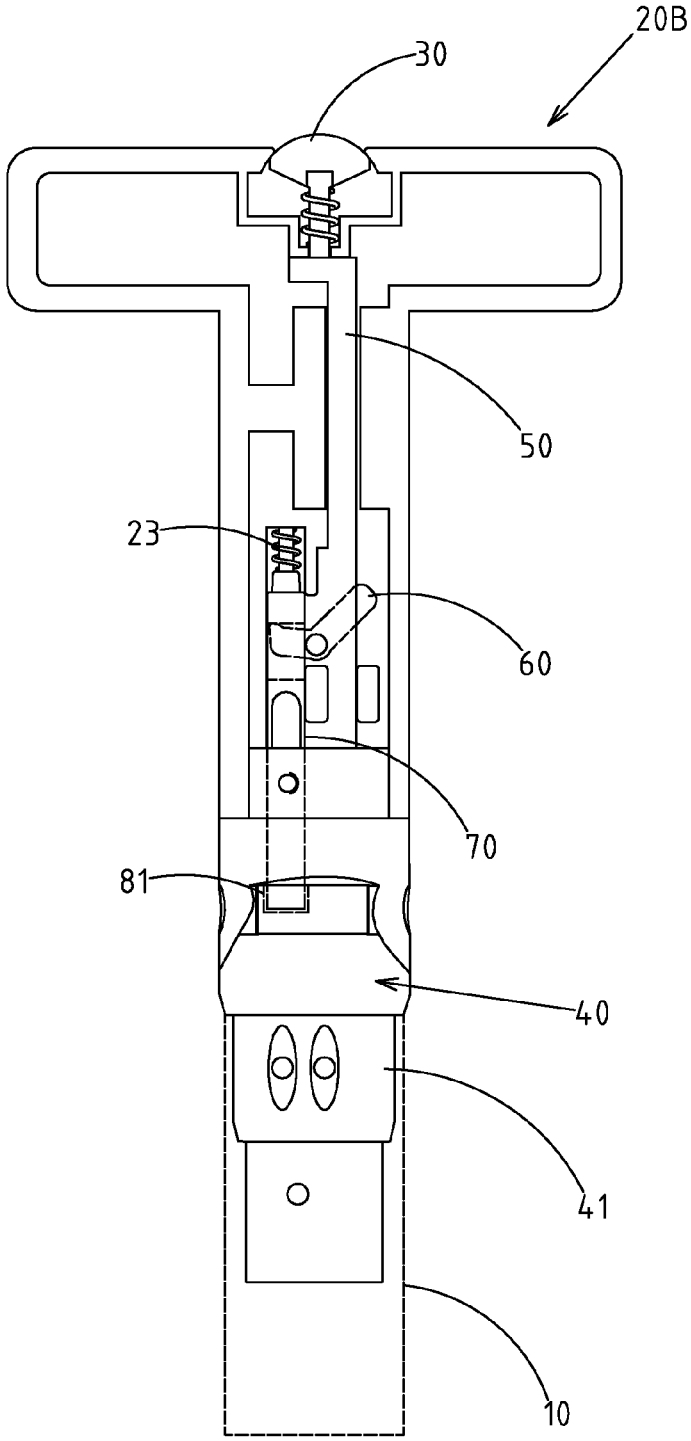
FIG. 12 shows another sectional view of an example of the grip handle of the present invention.

As shown in FIG. 12, the grip handle 20B is also available with a T type or a single button type.

As shown in FIG. 3, the fixation pin 70 can be provided with a square cross section with its bottom of a flat cone head 71.

Figure 10:
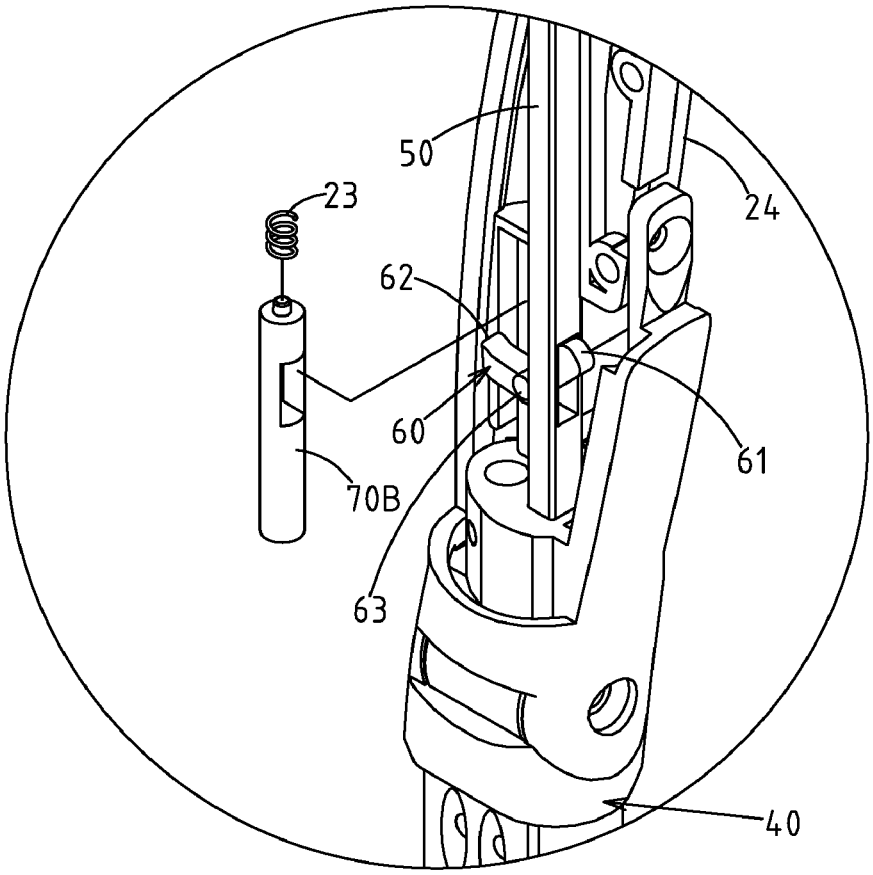
FIG. 10 shows a close-up perspective view of an example of the fixation pin of the present invention.

As shown in FIG. 10, the fixation pin 70B is also of a cylinder type.

I claim:

1. An adjustable grip handle of a luggage compartment comprising:

a pull handle, provided at one side of the luggage compartment;

a grip handle, provided at a top of the pull handle;

a button, mounted at a top of the grip handle;

a connecting base, provided at a bottom of the grip handle to make the grip handle rotate round the pivot; wherein a bottom of the connecting base is mounted with an insert unit at the top of the pull handle;

a linkage bar, vertically provided within the grip handle; wherein a top of the linkage bar is activated by the button while the bottom of the linkage bar is extended to the base of the grip handle;

a rotary bar having a revolving pivot and being provided at the bottom of the linkage bar to make the bar end swing as seesaw; wherein a first bar end of the rotary bar is connected to the bottom of the linkage bar for its activation;

a fixation pin, provided at the back end of the rotary bar said fixation pin shiftable vertically along a preset track inside the grip handle; wherein a top of the fixation pin is connected to the second bar end of the rotary bar, which can activate it to shift vertically; wherein, when shifting downwards, the bottom of the fixation pin can protrude from the base of the grip handle; and wherein, a top of the fixation pin is mounted with an elastic member to let the fixation pin elastically push downwards; and at least two fixation holes being separately arranged at the top of the connecting base, of which the first fixation hole can be joined with the base of fixation pin when the grip handle stands upright, and the second fixation hole can be joined with the base of fixation pin when the grip handle stands by a preset degree of curvature, wherein the base of fixation pin inserts into the corresponding fixation hole so as to fix the angle of grip handle.

2. The adjustable grip handle defined in claim 1, wherein said grip handle is comprised of connecting bars at left and right sides and a horizontal handle between the connecting bars; and wherein two groups of button, connecting base, linkage bar, rotary bar and fixation pin as well as two fixation holes are provided symmetrically within the connecting bars at the left and right sides of the grip handle; and wherein a horizontal transmission member is provided between the tops of left and right linkage bars so as to connect left and right linkage bars, wherein said left and right linkage bars activate simultaneously when pressing any button.

3. The adjustable grip handle defined in claim 2, wherein said horizontal transmission member comprises a balance pressure bar, internal/external gliding base and left/right transmission block, said left and right transmission blocks being right-angled triangle shaped and connected at both sides of horizontal handle of the grip handle via the help of shaft axle, and also placed at the tops of left and right linkage bars; wherein said balance pressure bar is horizontally provided within horizontal handle of the grip handle, with its bottom of both sides separately spanning over left and right transmission blocks; wherein a spring is arranged between its bottom side and the lower wall of the horizontal handle so as to uplift elastically the balance pressure bar; wherein a topside of the balance pressure bar is separately arranged with left and right stair-shape convexes; wherein internal and external gliding bases are provided at the upper side of the balance pressure bar for parallel connection; wherein outer side of internal and external gliding bases is separately connected to left and right buttons while the inner side is provided with inclines and separately conncected to left and right stair-shape convexes of the balance pressure bar wherein intermediate section of internal and external gliding bases is provided with a hollow notch; and wherein a rebound spring is placed between a notch wall at one side and a fixed wall of the horizontal handle, so as to enable internal and external gliding bases to push elastically towards the button.

4. The adjustable grip handle defined in claim 2, wherein said horizontal transmission member is horizontally placed within the horizontal handle of the grip handle, and its both ends are connected to the transverse handle at the top of left and right linkage bars, a single-element button being a preferred option, for the button can be provided at the topside of the center of the horizontal handle, while a convexity can be arranged at the topside of the center of the transverse handle to abut upon the bottom of the button, such that when pressing the button, it will suppress the convexity to push down the transverse handle, and then activate left and right linkage bars to shift downwards.

5. The adjustable grip handle defined in claim 1, wherein said grip handle is comprised of a T type or a single button type.

6. The adjustable grip handle defined in claim 1, wherein said fixation pin has a square cross section with a bottom thereof being a flat cone head.

7. The adjustable grip handle defined in claim 1, wherein said fixation pin is comprised of a cylinder type.

* * * * *